United States Patent [19]

Weber et al.

[11] Patent Number: 4,473,807

[45] Date of Patent: Sep. 25, 1984

[54] COAXIAL K INVERTER

[75] Inventors: Robert J. Weber, Marion; James C. Cozzie, Solon, both of Iowa

[73] Assignee: Rockwell International Corporation, El Segundo, Calif.

[21] Appl. No.: 434,997

[22] Filed: Oct. 18, 1982

[51] Int. Cl.[3] ..... H01P 1/202; H01P 5/04

[52] U.S. Cl. ..... 333/206; 333/33; 333/207; 333/232

[58] Field of Search ..... 333/202, 206–212, 333/219, 222–226, 263, 27, 33, 24 R, 256

[56] References Cited

U.S. PATENT DOCUMENTS 4,030,051 6/1977 Shimizu et al. ..... 333/256 X
4,255,729 3/1981 Fukasawa et al. ..... 333/202

OTHER PUBLICATIONS

Wakino et al.,–"Quarter Wave Dielectric Transmission Line Diplexer for Land Mobile Communications" MTT Symposium 1980; pp. 278–280.

Young et al.,–"Microwave Filters, Impedance-Matching Networks, and Coupling Structures", McGraw-Hill Book Company, New York, 1964; pp. 427–472.

*Primary Examiner*—Marvin L. Nussbaum
*Attorney, Agent, or Firm*—George A. Montanye; H. Fredrick Hamann

[57] ABSTRACT

An improved coaxial K inverter is disclosed for use in forming coaxial microwave filters. A filter including a K inverter may be constructed using at least one resonator including a conductor terminated at one end by an apertured plate and coaxially surrounded by a dielectric material. The resonator may be enclosed in a conductive housing electrically coupled to the apertured plate and capacitively coupled at the other end of the conductor to an input terminal for receiving microwave energy. A second conductor terminated at one end in a second apertured plate is positioned within the housing such that the apertured plates are adjacent one another forming a K inverter. The other end of the second conductor is capacitively coupled to an output terminal forming the electrical output from the filter.

10 Claims, 3 Drawing Figures

COAXIAL K INVERTER

BACKGROUND OF THE INVENTION

The present invention relates to high frequency filter circuits and more particularly to K inverters which may be utilized in coaxial microwave filters.

A variety of circuits for forming microwave and other high frequency filters are known in the prior art. Generally, it is known that a filter can be theoretically constructed using a combination of series resonators alternating with shunt resonators to produce a particular bandpass design. Practically, however, it is difficult to achieve a microwave structure which physically has the arrangement of alternating series and shunt resonators. Accordingly, an approximation of such a filter is formed using resonators in combination with impedance inverters to produce an effect similar to alternating series and shunt resonators and thereby enable the production of a practical microwave filter. The impedance inverters are generally known as K and J inverters and their effect and construction in exemplary prior known circuits is described in the book entitled "*Microwave Filters, Impedance-Matching Networks, and Coupling Structures*" by Matthew Young and Jones, McGraw-Hill, 1964, pp. 427–472 and in the article entitled "Quarterwave Dielectric Transmission Line Diplexer for Land-mobile Communications" by Wakino, et.al. in the MTT Symposium 1980, pp. 278–280.

Such filters, as are referred to above, generally include a plurality of two port quarter-wave resonators alternately coupled by K and J inverters to produce the series and shunt resonator effect needed to produce particular configurations of bandpass filters. Such configurations have been designed in various microwave circuits including stripline and coaxial embodiments. While such structures and circuits have enabled the successful construction of various high-frequency filters, there is a continuing need for new filter designs which enable reductions in size and complexity for use in new technology electronic systems. More particularly, in some prior art filter circuits using known resonator filtering techniques, the size of the structures required to form the resonators and K and J inverters does not allow any further reduction in filter size without significantly sacrificing filter operation and efficiency. In still other instances, filter circuits formed using precisely constructed elements of specific configurations require significant increases in the time and manpower employed in the manufacturing processes required to produce acceptable devices. In these instances, without precise manufacturing process control, the resulting filters are less efficient, do not have as wide a range of operation, and suffer from greater losses.

In an effort to overcome the above-mentioned and simiar deficiencies, other configurations have been proposed which simplify the construction of the filter and resonators included therein. One example is illustrated in U.S. Pat. No. 4,255,729 in which a plurality of resonators are enclosed within a conductive housing and coupled to one another to provide the requisite filter characteristics. While the structure attempts to reduce the reliance on precision manufacturing processes while improving coupling and reducing losses, there is a continuing need to provide further simplified structures capable of being applied in a variety of environments and being sufficiently versatile to allow variations in the filter characteristics.

Accordingly, the present invention has been developed to overcome the specific shortcomings of the above known and similar techniques and to provide a simplified and less expensive K inverter and filter circuit for use in high frequency systems.

SUMMARY OF THE INVENTION

In accordance with the present invention, at least one resonator, and typically a plurality of resonators, are positioned within a conductive housing adjacent one another to form a simplified K inverter in the filter. The resonators in the preferred embodiment include a cylindrical center conductor terminating in a circular apertured plate lying in a plane perpendicular to the axis of the cylindrical center conductor. A dielectric material surrounds the center conductor to form a coaxial cylinder adjacent the apertured plate. In one example, a resonator of similar configuraton may be positioned within the housing such that the apertured plates are located adjacent one another to form a K inverter. Conductive terminals from an input and output connector are spaced adjacent an end of each center conductor of the resonators to produce J inverters which capacitively couple an input signal from the input connector to one resonator through the K inverter, and from the center conductor of the second resonator to the output connector. The coupling and, accordingly, the bandpass of the resulting two-pole filter, may be adjusted by rotating the resonators with respect to one another to alter the alignment of the apertures in the plates and by altering the axial spacing between the two adjacent apertured plates. The filter is therefore capable of providing an easiy adjusted bandpass with a simplified K inverter, allowing more versatile and efficient operation of the filter circuit.

It is therefore a feature of the invention to provide a simple and inexpensive K inverter for use in high frequency filters.

It is a further feature of the invention to provide an improved resonator structure enabling the formation of K inverters in a high frequency filter system.

It is another feature of the invention to provide a high frequency filter system using at least one resonator and adjacent conductive plates forming a simplified K inverter.

It is a still further feature of the invention to provide a K inverter formed by adjacent apertured plates.

Still another feature of the invention is to provide quarter-wavelength resonators having a center conductor terminated in an apertured plate which cooperates with an adjacent apertured plate to form a K inverter for use in microwave filters.

Yet another feature of the invention is to provide adjacent resonators formed with opposed apertured plates cooperating to form a K inverter and having adjustable coupling provided by the rotation and spacing of the opposed apertured plates.

These and other advantages and novel features of the invention will become apparent from the following detailed description when considered with the accompanying drawings wherein:

DETAILED DESCRIPTION OF A PREFERRED EMBODIMENT

Figure 1:
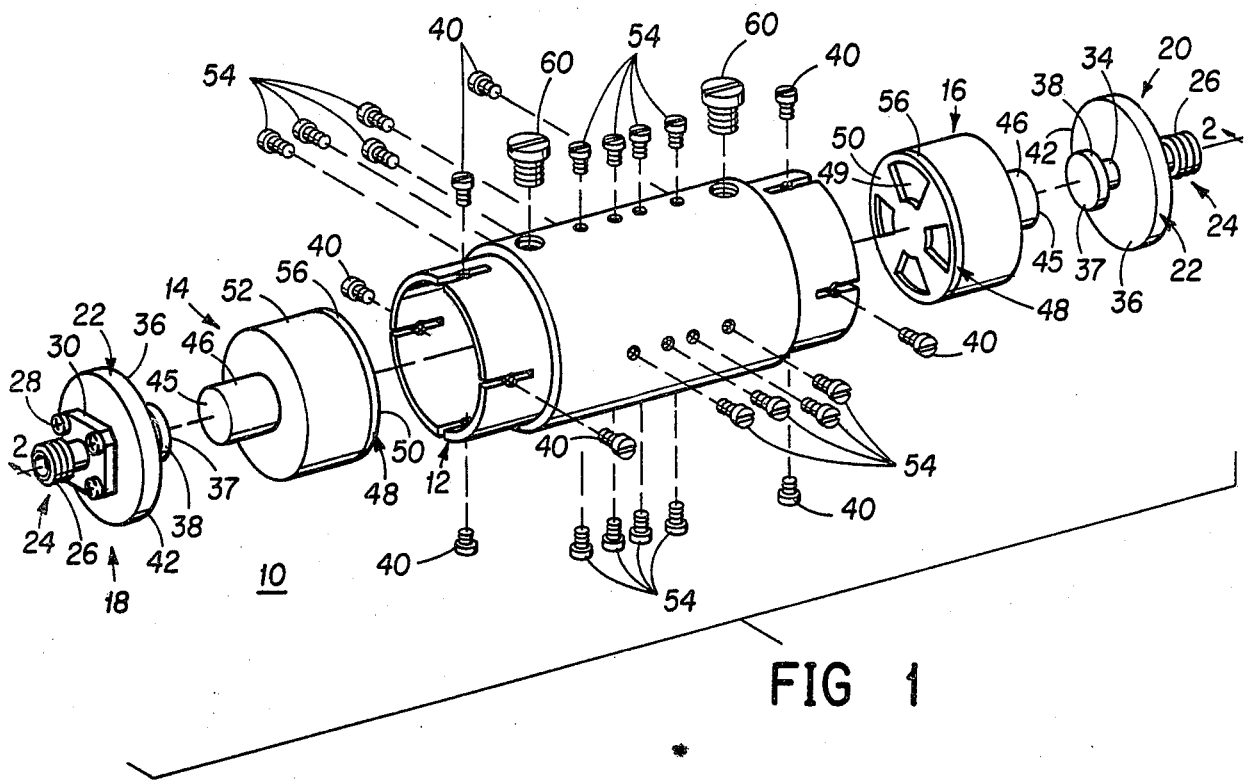
FIG. 1 is a detailed exploded view of one embodiment of the present invention.

Referring now to the drawings, wherein like numerals refer to like elements throughout, one embodiment of the invention is shown utilizing the inventive coaxial K inverter to form a two-pole filter 10 as shown in the exploded view of FIG. 1. The filter 10 includes an outer electrically conductive cylindrical housing or casing 12, which in the present instance may be formed from a machined copper tube. The inside diameter of the casing 12 is generally uniform along the length of the axis a (same as line 2—2) extending longitudinally through the center of the cylinder 12. A pair of resonators 14 and 16, each having identical cylindrical configurations are positioned adjacent one another centrally within the casing 12 and generally equidistant from the ends of the cylinder 12. End members 18 and 20, also having identical cylindrical configurations, are positioned one at each end of the cylinder 12 adjacent a respective one of the resonators 14 and 16 to form an end closure at each end of the cylinder 12.

The end members 18 and 20 are identical in construction and, in the present example each includes an electrically conductive circular disk 22 having a substantially uniform thickness and a diameter substantially equal to the inside diameter of the cylinder 12 such that the disks 22 of end members 18 and 20 may each be slidably received within the cylinder 12 and maintained in electrical contact with the inside surface of the cylinder. The disk 22 may be formed of any good electrically conductive material such as copper. Each end member 18 and 20 further includes an electrical connector which, in the present example, is shown as a coaxial connector 24 having an outer threaded coaxial electrical conductor 26 integrally attached to an electrically conductive base plate 30 and secured in electrical contact to the center of the disk 22 by screws 28. The connector 24 further includes a central coaxial electrical conductor 32 which extends along the axis a of the cylinder 12 centrally through the disk 22 and electrically insulated from the disk 22 and conductor 26 by coaxial sleeve 34.

As will be understood, the coaxial connector 24 is of well known construction but in the present instance, is modified such that the central conductor 32 extends through the disk 22 perpendicular to its face 36 and is thereafter terminated with an electrically conductive circular disk 38. The circular disk 38, also of a substantially uniform thickness, has its center positioned along axis a so that the face 37 of disk 38 is substantially perpendicular to axis a. In order to maintain the disk 22 in secure electrical contact with the cylinder 12, one or a plurality of electrically conductive screws 40 threadably extending through the wall of cylinder 12, may be spaced about the outer circumference of the cylinder 12 and positioned to forcefully engage the outer circumference 42 of the disk 22 to retain it within the cylinder 12 and in electrical contact therewith. The connectors 24 serve as input and output terminals for coupling high frequency energy through the filter 10 when it is inserted into an appropriate electrical circuit for operation.

The filter 10 further includes the two resonators 14 and 16 as previously described. Each of the resonators is identically constructed and in the present instance are each configured to form quarter-wave resonators. Each resonator 14 and 16 generally includes a center cylindrical electrical conductor 44 which has its cylindrical axis coaxial with axis a of cylinder 12 and which is terminated at one end by a co-linear cylindrical electrical conductor 46 forming a free end and having a diameter greater than the diameter of conductor 44 and substantially equal in diameter to the diameter of disk 38. Cylindrical conductor 44 is terminated at the other end by an apertured circular electrically conductive disk 48 of substantially uniform thickness and positioned to have axis a perpendicularly extending through its center. The diameter of disk 48 is substantially equal to the inside diameter of cylinder 12 so that disk 48 may be slidably received within the cylinder 12 and in electrical contact therewith.

The apertured disk or plate 48 includes a plurality of apertures 49 radially spaced about the center of the disk 48 and, in the present example, generally includes four trapezoidal apertures 49 spaced equidistantly from one another and at equal radial distances from the center of the disk 48 to form a symmetrical pattern on the face 50. Although the apertures 49 are particularly shown in a trapezoidal configuration and equidistant symmetrical spacing, other configurations, numbers, and shapes of apertures may be used to produce the effects as will be subsequently described.

The resonator further includes a cylindrical dielectric material 52 surrounding and in contact with the conductor 44 such that the conductor 44 extends through the center of the cylinder formed by the dielectric material. The dielectric cylinder 52 has a diameter substantially equal to the inside diameter of the cylinder 12 so that the resonators 14 and 16 may be slidably received and moved along axis a within cylinder 12. In order to more securely maintain electrical contact between the disks 48 and the cylinder 12, a plurality of electrically conductive screws 54 may be located about the circumference of the cylinder 12 and threadably extend through the wall of the cylinder 12 to engage the outer surface 56 of the disks 48. In the present example, the end faces 50 of the disks 48 are constructed to be substantially perpendicular to the axis a and parallel to one another when the disks 48 of resonators 14 and 16 are positioned adjacent one another within the cylinder 12. The screws 54 may extend through the wall of cylinder 12 in multiple positions along a line parallel to axis a such that the resonators 14 and 16 may be longitudinally spaced at different points along the axis a to vary the space 58 between the faces 50 of the disks 48.

The filter 10 further includes frequency adjusting screws 60 which are formed from an electrically conductive material such as copper, and which threadably extend perpendicularly through the wall of the cylinder 12 to a position adjacent the cylindrical conductors 46 within the cylinder 12. The conductors 60 act in a conventional manner to vary the center frequency of the filter 10. Since this adjustment is accomplished in a conventional manner, a detailed description of the adjustment screw 60 and its operation is not required for a further understanding of the invention.

Figure 2:
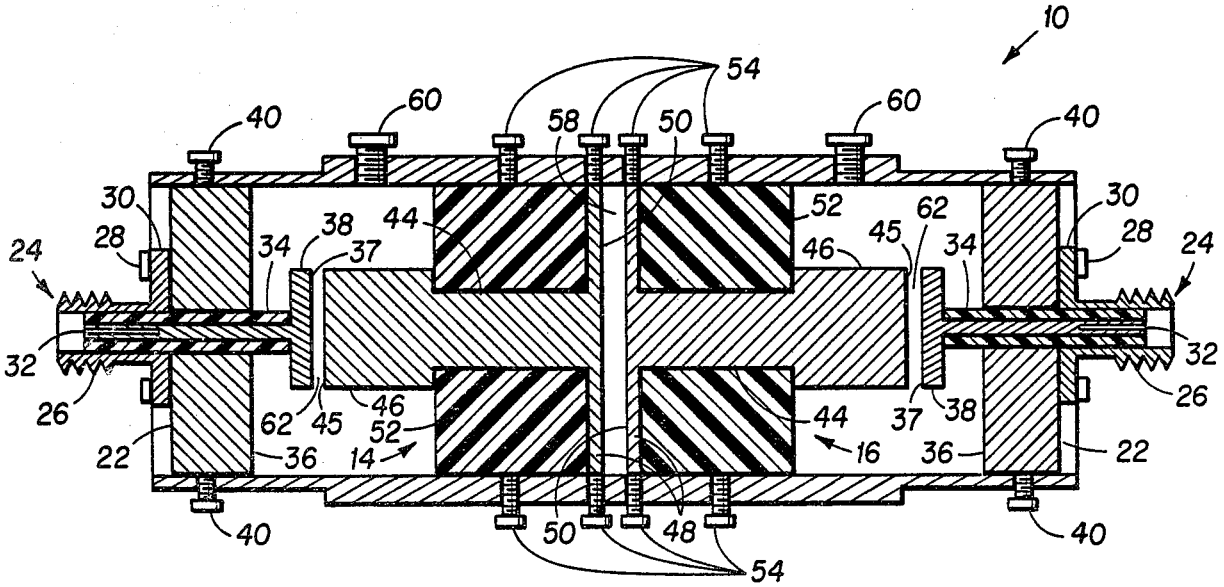
FIG. 2 is a side cross-sectional view of the embodiment of FIG. 1 taken along the line 2—2 in FIG. 1.
Figure 3:
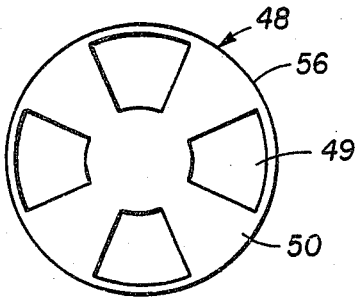
FIG. 3 is an end view of the apertured plate formed at one end of each of the resonators depicted in FIGS. 1 and 2.

In forming the filter 10, the two resonators 14 and 16 are positioned longitudinally along the length of the tube 12 as shown in FIG. 2. The resonators 14 and 16 are oriented such that the disks 48 are positioned adjacent one another and in opposed relationship to form the coaxial K inverter in accordance with the present invention. When positioned in this manner, the cylindrical conductors 46 extend in opposite directions from the ends of their associated resonators. The end members 18 and 20 are positioned at either end of the tube 12 such that the end faces 37 of the disks 38 are in opposed parallel relation to the end faces 45 of the cylindrical conductors 46. The space 62 between the disks 38 and conductors 46 is fixed to provide a capacitive coupling J inverter in a conventional manner. The spacing 62 may be adjusted to maximize that coupling by moving end members 18 and 20 regardless of the positioning of the resonators 14 and 16 longitudinally along the axis a. In order to provide effective coupling, the diameter of the disks 38 and cylinder 46 are fixed to be substantially equal although variations would obviously be acceptable so long as the appropriate coupling is achieved.

In constructing the resonators 14 and 16, the diameters of the center conductor 44 and cylindrical dielectric 52 are fixed at a predetermined ratio to produce minimium loss. This ratio is well known in the formation of such resonators and will not be described in greater detail herein, it being apparent that one of ordinary skill in the art would select the appropriate ratio to minimize that loss. Also, in forming the apertured disks 48, the disks are configured to have a uniform thickness and the thickness is maintained as thin as that which can be achieved using current technology. As the thickness of the disks increases, the bandpass of the filter decreases. The thickness is therefore reduced to provide the widest possible bandwidth.

The operation of the filter will now be described with particular reference to FIG. 2. Following the assembly of each of the resonator elements 14 and 16 within the cylinder 12 to form the K inverter, and following the insertion of the end members 18 and 20 such that the disks 38 are adjacent respective ones of the cylindrical conductors 46 of each resonator 14 and 16, high frequency energy may be supplied through one of the connectors 24. The output of that filter is then taken from the other connector 24 at an opposite end of the filter 10. In order to maximize the bandwidth of the filter, the resonators 14 and 16 may be moved adjacent one another such that the surfaces 50 of the plates 48 contact one another and the apertures 49 of the plates 48 longitudinally align with one another. Thereafter, when it is desired to vary the bandpass characteristics of the filter, the resonators 14 and 16 may be moved in several ways. First, one resonator may be rotated within the cylinder 12 with respect to the other resonator so that the apertures 49 of one resonator move out of alignment with the apertures 49 of the adjacent resonator. This movement decreases the coupling through the K inverter and thus varies the bandpass of the filter configuraton. Secondly, the longitudinal position of the resonators 14 and 16 with respect to one another may be varied by slidably moving each resonator 14 and 16 within the cylinder 12 along the axis a to vary the space 58 between the faces 50 of the apertured plates 48. As this movement is made, the coupling through the K inverter is again varied and the bandpass of the filter likewise changed. As will be appreciated, any combination of longitudinal movement and rotational movement of the resonators 14 and 16 may be made to simultaneously vary the spacing 58 and alignment of the apertures 49 to provide appropriate adjustment of the filter characteristics. Naturally, as the resonators 14 and 16 are moved, the end members 18 and 20 may also be moved to maintain the proper spacing at 62 for the J inverters.

In one example of the present invention, the filter was constructed such that the length of the cylindrical dielectric material formed a quarter-wavelength resonator having a length of one-half inch. The diameter of the dielectric in this instance was one inch. The diameters of the plates 48 and disks 22 were likewise one inch. The diameter of the central conductor 44 was fixed at one-quarter inch and the four apertures 49 were formed such that they were uniformly radially spaced from the outer circumference of disk 48 by one-sixteenth inch and radially spaced from the center of the disk 48 by three-sixteenth inch and alternated with substantially equal trapezoidal areas 50 of plate 48. The diameter of the cylindrical conductor 46 and disk 38 was maintained at three-eighths inch. Using adjusting screws 60, the center frequency was fixed at 862 MHz. The widest bandwidth (840 MHz to 884 MHz) was achieved when the plates 48 were in electrical contact and apertures 49 were aligned.

In accordance with the above-described formation of the coaxial K inverter and filter in accordance with the present invention, a filter having reduced dimensions from that of prior known devices has been achieved. By forming the K inverter using the adjacent and adjustable apertured plates, the K inverter allows easy adjustment of the bandpass with only simple changes in the filter configuration. The coupling achieved by the K inverter allows the filter structure to be simply constructed without high tolerances on any of the resonator or coupling elements. Complex structures for tuning and changing the bandwidth are not necessary, thereby allowing the filter to have greater versatility and increasing its efficiency in various applications. The filter may be constructed for effective operation in the 0.5–2 GHz range and has been found to significantly reduce the size requirements over that of conventional filters. The construction of filters in a manner similar to that described will likewise enable reductions in sizes in other frequency ranges. All of these are features which are not taught or described in any of the prior art.

Although the invention has been described particularly with respect to quarter-wavelength resonators and a specific two-pole filter, it is apparent that other configurations could be used. For example, any number of resonators may be alternately coupled within cylinder 12 to form filters of other characteristics. Adjacent pairs of resonators, for example, could be capacitively coupled through J inverters formed by adjacent cylinders 46 with each pair of resonators alternately forming J and K inverter couplings. Such a structure would then enable the production of filter characteristics in accordance with prior known theory. Additionally, although the structure has been described with reference to cylindrical resonators 14 and 16 and cylindrical casing 12, it is apparent that other configurations could be employed which would enable the longitudinal movement of resonators 14 and 16 and change in alignment of apertures 49. Naturally, the cylindrical unit would appear to provide the maximum adjustment attainable, but this does not preclude acceptable configurations where other shapes may be required by the application involved.

Obviously, many other variations and modifications are possible in light of the above teachings. It is therefore to be understood that within the scope of the appended claims, the invention may be practiced otherwise than as specifically described.

What is claimed is:

1. An adjustable K inverter for an electrical filter comprising:

a first conductor terminated in an electrically conductive apertured plate; and a second conductor terminated in a second electrically conductive apertured plate, said second apertured plate being movably positioned adjacent said first apertured plate.

2. The inverter of claim 1 further including a dielectric material surrounding said first conductor to form a resonator.

3. The inverter of claim 1 wherein said first and second conductors are each surrounded by a dielectric material and constructed and arranged to form separate quarter-wavelength resonators.

4. The inverter of claim 1 wherein said apertured plates are circular and said first and second conductors are cylindrical and attached centrally to said apertured plates so that the plates are perpendicular to a longitudinal axis of the cylindrical conductors.

5. In a high frequency filter structure constructed to form alternating parallel and shunt resonance circuits, the improvement comprising:

an electrically conductive housing;

a first resonator including a first electrical conductor having a free end and another end terminated in an apertured plate and surrounded by a dielectric material, said resonator being received in said housing so that said apertured plate and housing are in electrical contact;

a second electrical conductor having a free end and another end terminated in an apertured plate and movably positioned within said housing and in electrical contact therewith, said apertured plates being movable to vary the alignment of the apertures of each plate with respect to one another and the space between said plates; and means for coupling high frequency energy as input to one of said conductors and means for coupling high frequency energy as an output from the other of said conductors.

6. The filter of claim 5 wherein said conductor has an axis which is perpendicular to said apertured plate and wherein said apertured plate intersects said conductor and is radially symmetrical about the point of intersection.

7. The filter of claim 5 wherein said first and second conductors are cylindrical, said second conductor is surrounded by a dielectric material to form a resonator and said apertured plates have a circular configuration and intersect said conductors in the center of the circular plate.

8. The filter of claim 7 wherein the apertures of each plate are trapezoidal in configuration and are radially spaced from the center of each circular plate symmetrically about the center.

9. A high frequency filter having an adjustable K inverter comprising:

a cylindrical electrically conductive housing;

at least one first cylindrical resonator slidably received within said housing and including a first electrical conductor having a free end and an end terminated in an apertured plate, said first conductor being surrounded by a dielectric material and said apertured plate being maintained in electrical contact with said housing;

at least one second resonator slidably received within said housing and including a second electrical conductor having a free end and an end terminated in an apertured plate maintained in electrical contact with said housing, said second conductor being surrounded by a dielectric material, said second resonator being positioned within said housing such that the apertured plate of said second resonator is adjacent the apertured plate of said first resonator and said resonators are rotatable with respect to one another to vary the alignment of the apertures in the respective plates and are slidable along a longitudinal axis of the cylinder to vary the spacing between the apertured plates;

means at one end of said cylindrical casing for coupling high frequency signals as input to the free end of the conductor of one of said resonators; and means at an opposite end of said cylindrical casing for coupling high frequency energy as output from the free end of the conductor of the other of said resonators.

10. The apparatus of claim 9 further including a plurality of adjacent pairs of said at least one first and second resonators, each adjacent pair having a free end of one of its conductors capacitively coupled to a free end of one of the conductors of an adjacent pair to form a multiple pole filter.

* * * * *